United States Patent [19]

Bauer et al.

[11] Patent Number: 4,809,470

[45] Date of Patent: Mar. 7, 1989

[54] PANEL SYSTEM AND METHOD

[75] Inventors: Robert W. Bauer, Owosso; Charles R. Reck, St. Johns; Hans B. Wangeman, Haslett, all of Mich.

[73] Assignee: U.S. Brick, Inc., Owosso, Mich.

[21] Appl. No.: 945,581

[22] Filed: Dec. 23, 1986

[51] Int. Cl.[4] ..... E04F 13/08; E04C 5/18

[52] U.S. Cl. ..... 52/97; 52/105; 52/315; 52/387; 52/593

[58] Field of Search ..... 52/387, 391, 385, 386, 52/392, 314, 315, 316, 744, 105, 97

[56] References Cited

U.S. PATENT DOCUMENTS

| | | | |
|---|---|---|---|
| 658,868 | 10/1900 | Rosebaum | 52/387 |
| 1,861,359 | 5/1932 | Pyron | 52/387 |
| 1,975,769 | 10/1934 | Cederholm | 52/387 |
| 2,031,680 | 2/1936 | Tuthill | 52/387 |
| 2,087,931 | 7/1937 | Wallace | 52/387 |
| 2,293,331 | 8/1942 | Dahlberg | 52/387 |
| 2,938,376 | 5/1960 | Workman | 52/391 |
| 3,533,206 | 10/1970 | Passeno | 52/387 |
| 3,905,170 | 9/1975 | Huetteman | 52/314 |
| 4,011,702 | 3/1977 | Matyas | 52/387 |
| 4,026,083 | 5/1977 | Hoyt | 52/387 |
| 4,662,140 | 5/1987 | Porter | 52/387 |

FOREIGN PATENT DOCUMENTS

| | | | |
|---|---|---|---|
| 1478863 | 7/1977 | United Kingdom | 52/387 |

*Primary Examiner*—John E. Murtagh

*Attorney, Agent, or Firm*—Reed Smith Shaw & McClay

[57] ABSTRACT

A structure and method is disclosed for facilitating the construction of a brick facade. A panel is provided made of bonded vacuum formed polystyrene and extruded polystyrene foam. The outer portion is specially configured to secure bricks in place by a friction fit until mortar is laid. The rear surface of the bricks are secured by adhesive to the surface of the outer portion of the panel. Channel bars separate the bricks in a vertical direction while other spacing means are used to locate the bricks in the horizontal direction the proper distance from one another. The mortar is then laid in place by hand to create the effect of bricks laid by a mason. Because of the materials used and the configuration, the panel can be cut at the work site to accommodate variations in the structure being erected. The cutting operation can be accomplished by a commercial cutting knife, the panel nailed in place, and bricks laid within the panel by an unskilled construction worker.

29 Claims, 3 Drawing Sheets

PANEL SYSTEM AND METHOD

BACKGROUND AND DISCUSSION OF THE INVENTION

In building construction, there is still a substantial demand for the use of brick on exterior surfaces of both residential and commercial buildings. Often in construction environment, the exterior brick surfaces are not load bearing structures and function primarily as an aesthetically pleasing building material.

However, the use of regular size bricks laid by a mason can be a relatively expensive process. Masons are highly trained construction workers who have developed expertise in laying bricks which permits them to demand relatively high wages to lay the bricks in place. Even with this expertise, substantial time is required to construct a brick wall or other facade in a professional manner. The time and expense have often made the use of brick as a construction material prohibitive for many builders and developers.

Attempts have been made at fabricating veneer facing walls utilizing half-inch thick brick to reduce these costs. An example of such a system is shown in the U.S. Pat. No. 3,533,206 issued to Passeno, Jr. on Oct. 13, 1970 (hereinafter the Passeno patent). The structure disclosed by Passeno requires the use of a metal layer with a number of thin edges to support the bricks. A plurality of holes are formed entirely through at least the metal portion of the panel to accept the overflow of adhesive employed for retaining the building blocks in the proper disposition. The panel is provided with inwardly extending flanges to space the panels from a building wall and provide insulating dead air space.

There are a number of deficiencies which have characterized panels of this type. One is the use of aluminum for one of the panel surfaces to support the brick in place. Aluminum and other metals are subject to corrosion and deterioration creating paths for potential leakage. In addition, a metal panel is difficult to cut and shape in meeting custom requirements at the work site.

The insulation properties have not always been completely satisfactory. In the Passeno patent the insulating backing has a relatively low "R" value considering the thickness of the material. As a result, additional insulation may have to be installed on the exterior surface of the building structure before the paneling can be secured in place.

Certain types of paneling require that the brick be fixed to the panel at the factory and shipped to the site for erection. The problem with this approach is that there may be errors fabrication which cannot be corrected for at the work site, producing a facade which does not mate properly with other elements of the building.

In addition, the unique appearance of site laid brick is lost. Bricks and mortar age by changing color and texture. Factory made brick panels fabricated at different times age at different rates. When these panels are erected the color and texture differences can be readily perceived by the consumer. This lack of "genuineness" has detracted from what otherwise would be wider acceptance of a brick panel system.

A goal of any exterior siding is the minimization of moisture leakage through the exterior walls to interior surfaces. A problem which has plagued certain panel structures is that the prevention of leakage has not been satisfactory. Improper fabrication at the factory and erection at the construction site can create paths entirely through the panel. Moisture can find its way through such paths and damage the dry wall on the interior of the house. Thus, the prevention of moisture flow through the panel structure is critical.

The problems noted above have largely been solved by the invention described herein. The panel configuration of the invention is easily adaptable to various building structures, such as windows, doors, and other openings, for example. The panel can be quickly and efficiently secured to studs or other load bearing surfaces in proper alignment. The bricks are friction-fitted into the panel and remain there until the adhesive is sufficiently hardened and the mortar is laid.

Extruded foamed polystyrene forms an inner portion of backing to obtain a greater insulation value for the thickness of the material employed. The outer portion of the panel is vacuum-formed polystyrene of a relatively thin dimensions when compared to the thickness.

A number of equally spaced channel bars which form the channels in which the bricks are held in place until they are secured by adhesive and mortar. The channel bars themselves are specially configured and sufficiently resilient to hold the bricks in the panel after being pressed into place. The thickness of the channel bars corresponds to the distance between the bricks which would normally occur if the bricks were laid by a mason for the laying of mortar. The height of the channel bars is somewhat less than the thickness of the bricks so that there will be sufficient space for receiving the mortar once the bricks have been properly located in the panel.

Recesses and smooth surfaces are provided along the length of alternate channels between the channel bars to facilitate securing the panel to a stud or other structure. The recesses enable portions of certain fastening means to be relieved below the surface of the channels so as not to interfere with the adhesive bonding of the brick to the channel surface.

A drip edge is provided on the lowermost surface panel to interact with a corresponding channel bar of an adjacent panel or the ground to impede the seepage between interfaces. Similarly, the side walls of the panels are provided with a tongue and groove configuration, again to insure that they interlock properly when mounted on the building structure and to minimize the moisture leakage.

The above has been a brief discussion of some problems with prior panels and features of the invention which overcome these problems. Other features of the invention will become more apparent from a detailed description of the preferred embodiment which follows.

DETAILED DESCRIPTION OF THE PREFERRED EMBODIMENT

Figure 1:
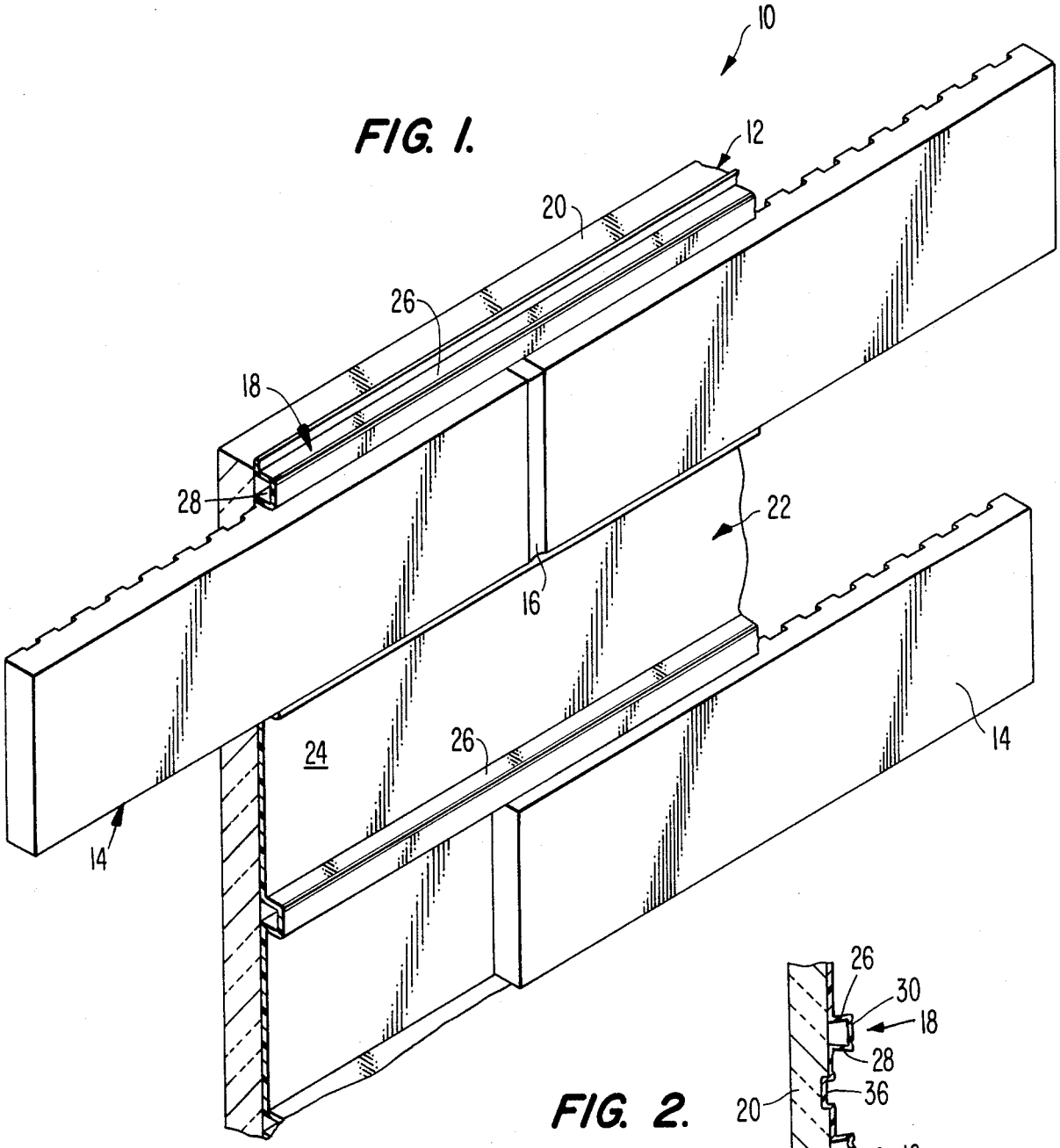
FIG. 1 is a perspective view of a portion of the panel with a number of bricks held in place between channel bars.

As can be seen in FIG. 1, a portion of the panel system 10 is shown with brick facing members (or bricks) held in place by frictional engagement due to the special configuration of the channel bars 18. More specifically, the panel system 10 includes a panel 12 having bricks laid in channels 24 formed between channel bars 18. Once the bricks have been laid in place, mortar is laid between abutting brick members in the same channel as well as the space formed by the channel bars 18 and adjacent bricks. This system permits the bricks to be adhered in place within the channels by a relatively unskilled worker prior to mortar being laid in place. The details of the panel configuration itself are described below.

Figure 2:
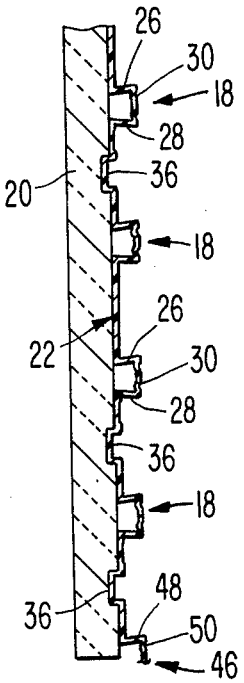
FIG. 2 is a partial cross section of the panel system as shown in FIG. 4 taking along lines 2—2.

With regard to FIG. 2, it can be seen that the panel 12 includes an inner portion of foamed plastic that is substantially thicker than an outer portion which is made of vacuum formed polystyrene. Inner portion 20 is formed of extruded foamed polystyrene although other kinds of foamed polystyrene insulating materials can be used. It has been found that the extruded foamed polystyrene yields the best insulative value for the thickness and cost of the material used. In the preferred embodiment, this thickness is about one (1) inch and has an R factor between seven (7) and nine (9).

The vacuum formed polystyrene outer layer 22 is substantially thinner than the foamed polystyrene inner layer 20 and is about 0.030 inches in thickness. The outer layer 22 is bonded to the inner portion 20 to form a laminate structure, except for channel bars which may have portions distended from the inner portion. A characteristic, of polystyrene layer 22, as well as the foamed polystyrene material, is its ability to be cut at the job site by an industrial knife or some other cutting means. In addition, the vacuum formed polystyrene is substantially impervious to moisture and other fluids which could otherwise penetrate the panel and damage the interior walls.

Figure 4:
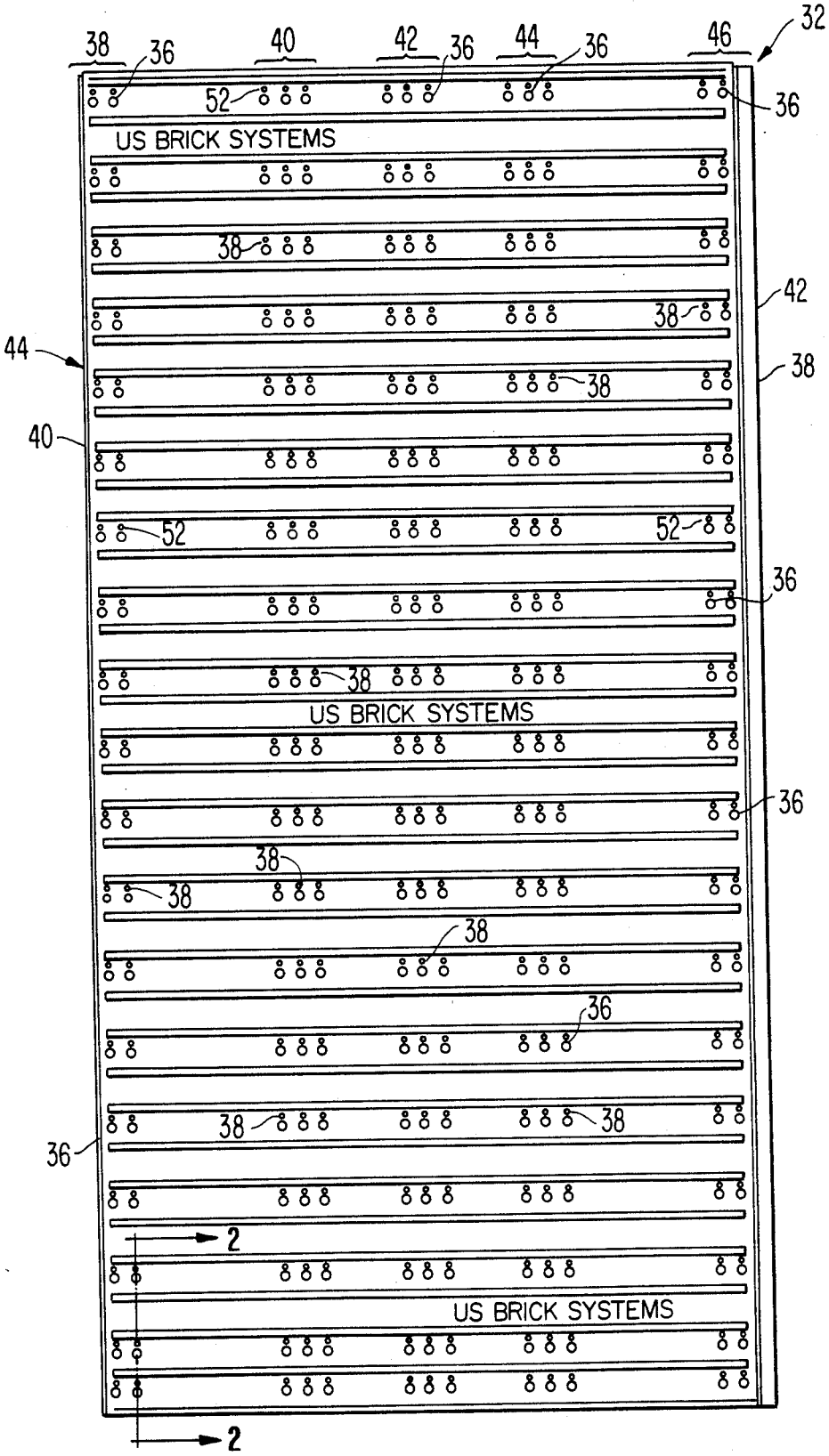
FIG. 4 is a front view of the panel.

In FIG. 2 it can be seen that panel 10 includes a number of horizontal channel bars 18 arranged in parallel configuration equidistantly from one another over the entire front surface of the panel as can be seen in FIG. 4. Channel bars 18 form channels in which the bricks are inserted and held in place until a mortar is laid in spaces between bricks 14. Channel bars 18 have a specific configuration to accommodate the bricks 14 as well as the mortar 16. As can be seen in FIG. 2, each channel bar 18 includes an upper wall 26 and a lower wall 28 which extends outwardly from channel 24 of the outer portion 22 of panel 10. Each of the upper and lower walls, 26 and 28, respectively is at an angle of about 83 degrees to the channel surface 24 and extends in opposite directions to create a dovetail appearance. These walls are deformable to deflect toward each other upon the insertion of a brick between channel bars 18 and away from each other upon removal.

Figure 5:
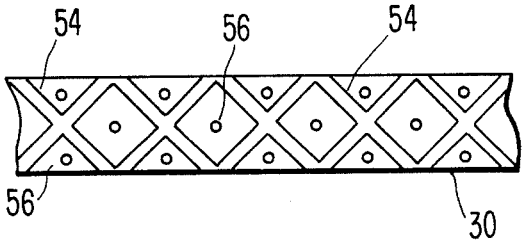
FIG. 5 is an enlarged view of a top portion of a channel bar as shown FIG. 1.
Figure 6:
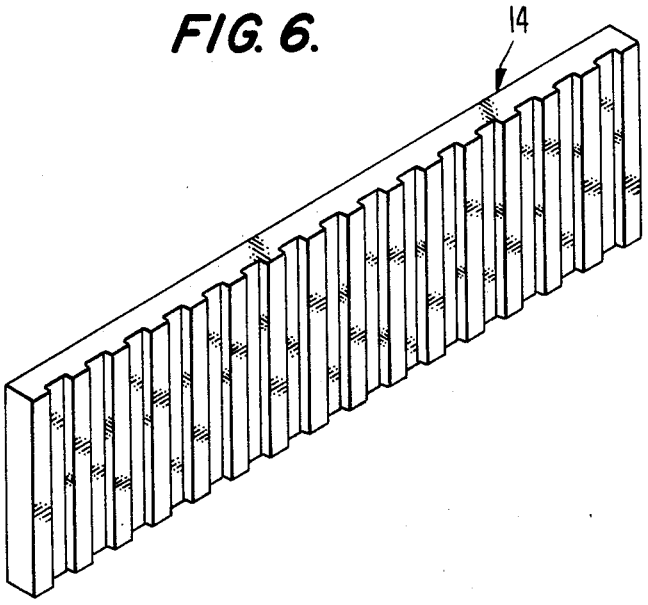
FIG. 6 is a perspective view of a rear portion of a brick facing.

Outer surface 30 of each channel bar 18 is specially configured to receive and hold mortar once it is in place between bricks 14. From FIG. 5 the configured surface includes diamond shaped grooves 54 and dimples 56. The dimples are arranged in three rows along the length of the channel bar 18 and are spaced symmetrically among the grooves. Other configurations can be used, but this one has been found to be particularly satisfactory.

In this embodiment the overall height of each channel bar 18 is about half the thickness of the brick itself. This insures that once bricks 14 are in place there is sufficient space remaining above channel bars 18 to receive mortar and provide the overall appearance of a hand masoned brick facade.

With this system, the panel 12 can act as the outer insulating wall in addition to supporting bricks. During construction, it can simply be nailed in place against the studs or secured against another supporting structure. After adhesive is brushed or sprayed on the back surface, each brick 14 is simply placed in the channels 22 and secured there by friction until mortar is applied. This process can be accomplished substantially without a mason or any other skilled bricklayer. Rather, almost any construction worker, once apprised of the operation of the system elements can accomplish this task.

Each channel 22, as can be seen in FIGS. 2 and 4, includes a number of recesses 36 across the length of the channel to accommodate fastening means without adversely affecting the adhesion of bricks 14 to the channel. For example, as can be seen in FIG. 4, a series of recesses 36 extend across alternate channels and are arranged in vertical columns, column 1,38, column 2,40, column 3,42, column 4,44, and column 5,46 to provide a uniform system for securing panel 10 to support structure on the building. It should be noted that columns 1 and 5 have two such recesses in a row, while columns 3, 4, and 5 have three in a row the preferred embodiment. Other arrangements could be used as long as there are a sufficient number of recesses to accommodate the number of fastening means to meet code requirements. This system permits the panel to be aligned with a corner quickly with one or more remaining columns being aligned with an adjacent stud.

For example, as in viewing FIG. 4, the left edge having the first column is secured adjacent a corner. If the studs, for example, are spaced sixteen (16) inches apart, the first, second, fourth, and fifth columns of recesses 36 would be used. On the other hand, if the studs are arranged at twenty-four (24) inches apart, the first, third, and fifth columns of recesses would be used for the fastening means. Consequently, the panel is configured to accommodate the two types of arrangements of studs generally used in building construction. Of course, these columns and rows can be arranged differently to accommodate different systems if required.

Another advantage of the columns 38, 40, 42, 44 and 46 is to insure that panels 10 are arranged properly in a vertical direction. When panels 10 are affixed to the studs above or below on adjacent panel, the various columns of recesses and smooth surfaces should align to insure that the panel is in the proper disposition with respect to an adjacent panel.

A logo is also used in the preferred embodiment in the second, eighteenth, and thirty-fourth channel as shown. In addition to providing identification and source of quality of the goods, the logo can also be used to align adjacent panels 10 in the horizontal direction. When the construction worker erects a panel in a side by side relationship to another panel 10, he can quickly see whether the logo's are aligned to assure that each panel is in the proper disposition relative to the other.

Half-inch calibrations are scribed on the top and bottom edges, as well as the side edges of the panel. This enables each panel 10 to be used as a measuring device for locating the panel with respect to other elements of the building and for cutting portions of the panel to desired size.

The recesses in each row and column are generally cylindrical configuration. In the preferred embodiment, the recesses are fastener relief holes about one-half inch in diameter and about one-eighth of an inch in depth. The purpose of these recesses is to insure that for a fastener used in a particular recess, the head portion does not extend above the plane of the channel 22. If nails are used, on the other hand, they simply can be nailed through the panel at a site of smooth spots 38 located just above recesses 36. Since the nail head is relatively flat, it often does not pose the same problem as bolts or screws which have a significant head portion which could otherwise extend above the plane of the channel.

As mentioned before, it is desirable to maintain the channel surfaces relatively flat while being sufficiently roughened so that the bricks can be properly adhered thereto by an adhesive. Another advantage of the recess, particularly one cylindrical in configuration, is that a close engagement occurs between the panel surfaces and the fastener when the fastener extends through the panel. If some other configuration were used there is a potential of gaps occurring at the interface between fastener and the panel which could cause the adhesive to seep therethrough or moisture to find its way through the panel along the interface between the fastener and the panel surfaces.

As can be seen in FIG. 4, the outer portion 22 of the panel has dimensions slightly less than the inner portion 16. This insures that the panels can be placed in abutting relationship without the outer portion interengaging or otherwise overlapping with an outer portion of an adjacent panel. If there were such an overlapping arrangement or interengagement, it might create buckling or gaps through which moisture could seep or which might otherwise interfere with the proper disposition of the panel at the construction site.

Figure 3:
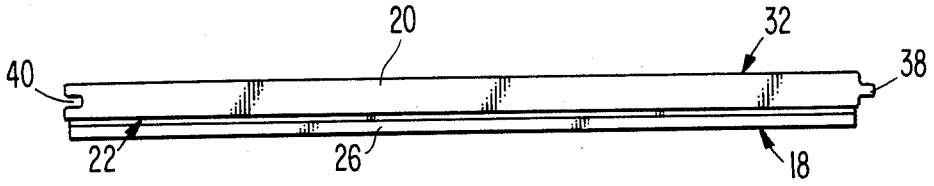
FIG. 3 is a top view of a panel.

As can be seen in FIG. 3, one side of the panel has a tongue 38 while the complementary opposite side of the panel has a groove 40 known in the industry as the tongue and groove panel. Both the tongue 38 and groove 40 extend the entire length of each panel as can be seen in FIG. 4. When panels 10 are placed in the proper abutting position, tongue 38 of one panel will fit into complementary groove 40 of an adjacent panel. In this way, moisture again is generally prevented or greatly impeded from moving through the panels. The tortuous path created by the tongue and groove configuration makes it difficult for any moisture to pass through the panel elements and ultimately to the interior portion of the building. When the bricks are laid, the center portion of brick 14 overlaps abutting surfaces 44, and 46 of the panels. With this configuration, the joints among the mortared bricks are displaced from panel joints to further impede or prohibit the flow of moisture through the panel system.

A drip edge 46 is arranged along the entire width of the bottom portion of the panel 10. This drip edge includes a lateral part 48 extending outwardly and an outer flange 50 extending downwardly from the end of lateral part 48 about a quarter of an inch in each direction. Drip edge 46 is so configured that, when it is placed in abutting relationship above another panel, it will interengage or overlap the channel bar along the top surface of the lower panel to provide a transition between panels direction. If a panel is placed at ground level, drip edge 46 will extend to the ground and impede the flow of moisture or other fluids from the ground through the interface between the panel and the ground surface to the interior portion of the building.

In operation, the panels are typically manufactured at a location remote from the actual construction site. They are shipped to the construction site with each panel having the configuration as discussed above. At the site, the various panels 10 can be cut, if necessary, to a smaller size or otherwise configured to accommodate windows, doors, or other custom aspects of a particular building. Once they have been properly cut, the panel is located to the correct position at the site and affixed to the studs or other affixing means through the recesses 36 if bolts or screws are being used. Otherwise, the panels can be nailed in place by driving nails through smooth spots 38 as noted. Once a number of panels 10 have been erected, both vertically and horizontally, over a given area of the construction site, bricks 14 can then be laid in place. Initially, an adhesive is employed and pasted on the back of the bricks or on the channel surface 22. After the adhesive has been applied, the brick is simply pushed into place in a given channel 22 between the channel bars 18. As discussed above, because of their resilience, channel bars 18 engage the brick 14 and hold it in place until the adhesive has hardened.

After a number of bricks 14 have been laid in place in this manner, they can then be mortared. The space between the bricks in the vertical direction is defined by the channel bars 18. In the horizontal direction, however, spacing means is employed to space the bricks properly. Once the bricks are inserted with the proper spacing and the adhesive has hardened, the mortar can be laid in place by a trowel or other means for this purpose into the voids defined between the bricks and the horizontal and vertical direction. These steps can be accomplished by a general construction worker and does not require the expertise of a mason.

Once the bricks have been laid in and the mortar is subsequently in place, the brick facade is largely completed. The process is reiterated for every area at the construction site where the brick facade is desired.

The panel size shown in the drawings has a width dimension of 48 inches and a length of 96 inches. The channel bars 18 have a height dimension of about 0.25 inches and a width of about 0.45 inches. Recesses have a depth of about 0.125 inches and a diameter of about 0.5 inches. The bricks have standard dimensions except for the thickness which is about twice that of the height of the channel bars 18. Other sizes can be used so long as they include the features discussed above.

With this system, the cost of erecting a brick facade is tremendously reduced. In addition, certain efficiencies are achieved which cannot be achieved when a mason is used. The reduction of moisture leakage through the structure are improved. Full size bricks are not required, again reducing the cost of materials being used. The time to construct a brick facade is compressed, producing substantial savings in manpower. These are just a few features which permit reduction in cost without any reduction in efficiency or appearance.

The above has been a detailed discussion of the preferred embodiment. The scope of the invention should not be limited to those features described in the preferred embodiment but should include all equivalents consistent with the improvement over the prior art and the claims which follow.

What is claimed:

1. A panel for use in building construction in conjunction with bricks of orthogonal configuration having a front face, a rear face, a first and second opposed sides and a first and second opposed ends with thickness of said sides and ends being less than the width or length dimension of said front and rear faces, comprising:

(a) an inner portion, including insulating material, (b) an outer portion for supporting bricks, (c) said outer portion being bonded to said inner portion, (d) said panel having a length and width dimension;

(e) a number of equally spaced channel bars forming channels with substantially flat bottom surface corresponding to the widths of bricks to be supported on said panel, each of said channel bars having a substantially constant cross section along its entire length and extending substantially the entire width dimension of said panel and being sufficiently resilient to hold said bricks between adjacent channel bars by friction; and (f) said channel bars being configured to deform and engage the sides of a brick to be supported upon pressing said brick into said channel.

2. The panel according to claim 1 wherein each of said channel bars being substantially of uniform height along its entire length, the height of each channel bar being less than the thickness of the brick to form a horizontal space of sufficient depth between adjacent bricks to receive mortar for holding the bricks in place.

3. The panel according to claim 2 wherein each of said channel bars includes a top wall and a bottom wall spaced from one another sufficiently to permit the reception of mortar to hold the bricks in place, said walls being deformable to deflect toward each other upon the insertion of the brick between the channel bars and away from each other upon removal of the brick or in a normal disposition.

4. The panel according to claim 3 wherein said top wall and said bottom wall of each channel extends outwardly from the base portion of said outer portion at an acute angle of about eighty-three degrees.

5. The panel according to claim 3 wherein the outer surface of said outer portion for supporting the bricks is roughened to provide an adhesive surface for adhesive bonding of brick to the panel.

6. The panel according to claim 5 wherein the outer surface of each of said channel bars includes grooves and dimples for holding the mortar in place.

7. The panel according to claim 1 further including a number of recesses to accommodate fastening means which when inserted through the panel will not extend above the surface between the channel bars for attaching the panel to support structure of the building with which the panel is being used.

8. The panel according to claim 7 further comprising a number of smooth spots generally circular in configuration and having an effective diameter smaller than said recesses for locating nails when used as a fastening means.

9. The panel according to claim 8 wherein said recesses are arranged in columns, said columns spaced to accommodate the spacing between a number of studs used in construction of buildings so that columns will be aligned with studs for fastening the panel thereto.

10. The panel according to claim 9 wherein five (5) columns of recesses are arranged to accommodate different spacing of studs, the first column including two (2) recesses in a row adjacent to one side of the panel, the second, third, and fourth columns each including three (3) recesses in a row to align with a stud spaced either sixteen (16) or twenty-four (24) inches from the first row and a fifth column located adjacent the opposite side of panel having two (2) recesses in a row.

11. The panel according to claim 1 wherein the outer portion of the panel has a first side edge and a second side edge and said inner portion includes a lateral extension slightly beyond at least each side edge of the outer portion of said panel sufficiently to avoid engagement of adjacent edges of outer portion of panels when arranged in abutting relationship.

12. The panel according to claim 1 wherein one side of said inner portion has a tongue configuration and an opposite side of said inner portion has a groove configuration for permitting tongue and groove interengagement between adjacent panels to prevent the leakage of moisture therethrough once the panel is erected properly.

13. The panel according to claim 1 wherein said panel includes a top portion and a bottom portion, further comprising a ledge extending from said bottom portion of the panel for overlapping of an adjacent panel if located therebeneath and for extending to the ground if located adjacent to the ground to impede leakage of moisture.

14. The panel according to claim 1 further comprising a number of bricks having dimensions to fit within the channels between said channel bars and having a thickness greater than that of the height of said channel bars to provide a space for receiving mortar between bricks.

15. The panel according to claim 14 wherein said panel has a width dimension of about forty-eight (48) inches and a height dimension of about ninety-six (96) inches, said channel bars having a height dimension of about 0.25 inches and a width of about 0.45 inches, said recesses having a depth of about 0.125 inches and a diameter of about 0.5 inches, each said bricks having standard dimensions except for the thickness which is about twice the height of said channel bars.

16. A panel for use in building construction comprising:

(a) an inner portion, including insulating material;

(b) an outer portion for supporting bricks;

(c) said outer portion being bonded to said inner portion;

(d) a number of equally spaced channel bars forming channels corresponding to the widths of bricks to be supported on said panel, said channel bars being sufficiently resilient to hold said bricks between adjacent channel bars by friction;

(e) each of said channel bars being substantially of uniform height along its entire length, the height of each channel bar being less than the thickness of the brick to form a horizontal space of sufficient depth between adjacent bricks to receive the mortar for holding the bricks in place;

(f) each of said channel bars further including a top wall and a bottom wall spaced from one another sufficiently to permit the reception of mortar to hold the bricks in place, said walls being deformable to deflect toward each other upon the insertion of the brick between the channel bars and away from each other upon removal of the brick or in a normal disposition;

(g) said top wall and said bottom wall of each channel extending outwardly from the base portion of said outer portion at an acute angle of about eighty-three degrees;

(h) said outer portion having an outer surface for supporting the bricks and being roughened to provide an adhesive surface for adhesive bonding of brick to the panel; and (i) the outer surface of each of said channel bars including grooves and dimples for holding the mortar in place, said grooves being formed in a diamond configuration with said dimples arranged in three rows along the length of the channel and spaced symmetrically between the grooves to form the diamond.

17. The panel according to claim 7 wherein said outer portion is vacuum formed polystyrene having a thickness dimension substantially less than that of the inner portion.

18. The panel according to claim 17 wherein said inner portion is formed of polystyrene foam sufficiently thick to provide insulating properties.

19. The panel according to claim 18 wherein the inner portion is formed from extruded polystyrene foam.

20. The panel according to claim 19 further including a number of recesses to accommodate fastening means which when inserted through the panel will not extend above the surface between the channel bars for attaching the panel to support structure of the building with which the panel is being used.

21. The panel according to claim 20 further comprising a number of smooth spots generally circular in configuration and having an effective diameter smaller than said recesses for locating nails when used as a fastening means.

22. The panel according to claim 21 wherein said recesses are arranged in columns, said columns spaced to accommodate the spacing between a number of studs used in construction of buildings so that columns will be aligned with studs for fastening the panel thereto.

23. The panel according to claim 22 wherein said (5) columns of recesses are arranged to accommodate different spacing of studs, the first column including two (2) recesses in a row adjacent to one side of the panel, the second, third, and fourth columns, each including three (3) recesses in a row to align with a stud spaced either sixteen (16) or twenty-four (24) inches from the first row and a fifth column located adjacent the opposite side of panel having two (2) recesses in a row.

24. The panel according to claim 23 wherein said inner portion includes a lateral extension slightly beyond at least each side edge of the outer portion of said panel sufficiently to avoid engagement of adjacent edges of outer portion of panels when arranged in abutting relationship.

25. The panel according to claim 24 wherein one side of said inner portion has a tongue configuration and an opposite side of said inner portion has a groove configuration for permitting tongue and groove interengagement between adjacent panels to prevent the leakage of moisture therethrough once the panel is erected properly.

26. The panel according to claim 25 wherein said panel includes a top portion and a bottom portion, further comprising a ledge extending from said bottom portion of the panel for overlapping of an adjacent panel if located therebeneath and for extending to the ground if located adjacent to the ground to impede leakage of moisture.

27. The panel according to claim 26 further comprising a number of bricks having dimensions to fit within the channels between said channel bars and having a thickness greater than that of the height of said channel bars to provide a space for receiving mortar between bricks.

28. The panel according to claim 27 wherein said panel has a width dimension of about forty-eight (48) inches and a height dimension of about ninety-six (96) inches, said channel bars having a height dimension of about 0.25 inches and a width of about 0.45 inches, said recesses having a depth of about 0.125 inches and a diameter of about 0.5 inches, each said bricks having standard dimensions except for the thickness which is about twice the height of said channel bars.

29. A panel used in building construction comprising for use in conjunction with bricks having a width and length (a) an inner portion of foamed polystyrene;

(b) an outer portion of vacuum formed polystyrene substantially coextensive with said inner portion said outer portion having a thickness substantially less than said inner portion and being bonded to said inner portion by adhesive;

(c) said outer portion defining a number of equally spaced channel bars forming channels therebetween each channel having a width corresponding to the width of the brick;

(d) each channel bar extending substantially the entire width of the panel and having a substantially uniform cross-sectional configuration therethrough, the height of each channel bar being less than the thickness of the brick to form a horizontal space for receiving of sufficient depth to receive mortar;

(e) each channel includes a top wall and a bottom wall each wall extending outwardly at about an eighty-three degree angle in diverging relationship to form a dove-type configuration, said walls being sufficiently resilient to hold bricks in channel by friction; and (f) a number of channels including a series of recess to provide relief for fastening means.

* * * * *